US007777078B2

(12) United States Patent
Kumagai et al.

(10) Patent No.: US 7,777,078 B2
(45) Date of Patent: Aug. 17, 2010

(54) COPPER ELECTROLYTIC SOLUTION AND ELECTROLYTIC COPPER FOIL PRODUCED THEREWITH

(75) Inventors: Masashi Kumagai, Hitachi (JP); Mikio Hanafusa, Hitachi (JP)

(73) Assignee: Nikko Materials Co., Ltd., Tokyo (JP)

( * ) Notice: Subject to any disclaimer, the term of this patent is extended or adjusted under 35 U.S.C. 154(b) by 1449 days.

(21) Appl. No.: 10/531,645

(22) PCT Filed: Oct. 10, 2003

(86) PCT No.: PCT/JP03/13044

§ 371 (c)(1),
(2), (4) Date: Apr. 15, 2005

(87) PCT Pub. No.: WO2004/055246

PCT Pub. Date: Jul. 1, 2004

(65) Prior Publication Data

US 2006/0166032 A1 Jul. 27, 2006

(30) Foreign Application Priority Data

Dec. 18, 2002 (JP) ..... 2002-366353

(51) Int. Cl.
*C07C 223/00* (2006.01)
*C07C 211/00* (2006.01)

(52) U.S. Cl. ..... 564/292; 564/295

(58) Field of Classification Search ..... 252/62.2, 252/390, 401; 423/592.1; 564/292, 295
See application file for complete search history.

(56) References Cited

U.S. PATENT DOCUMENTS 2,842,488 A * 7/1958 Strauss et al. ..... 205/297
4,336,114 A 6/1982 Mayer et al.
4,555,315 A 11/1985 Barbieri et al.
4,692,316 A * 9/1987 Greaves et al. ..... 422/16
5,607,570 A 3/1997 Rohbani
6,183,622 B1 2/2001 Janik
6,231,742 B1 5/2001 Sano et al.
6,291,081 B1 9/2001 Kurabe et al.

FOREIGN PATENT DOCUMENTS

JP 61-52387 3/1986
JP 2000-297395 10/2000
WO WO 01/53569 A1 7/2001

* cited by examiner

*Primary Examiner*—Alexa Neckel
*Assistant Examiner*—Zulmariam Mendez
(74) *Attorney, Agent, or Firm*—Flynn, Thiel, Boutell & Tanis, P.C.

(57) ABSTRACT

The present invention provides a copper electrolytic solution used to obtain a low-profile electrolytic copper foil with a low surface roughness on the rough side (the opposite side from the glossy side) in the production of an electrolytic copper foil using a cathode drum and, more particularly, to provide a copper electrolytic solution used to obtain an electrolytic copper foil that has excellent transmission loss characteristics at a high frequency, can be finely patterned, and has excellent elongation and tensile strength, both at ordinary and high temperatures. The copper electrolytic solution of the present invention contains (A) at least one quaternary amine salt selected from the group consisting of (a) quaternary amine salts obtained by a reaction between epichlorohydrin and an amine compound mixture composed of a secondary amine compound and a tertiary amine compound, and (b) poly-epichlorohydrin quaternary amine salts, and (B) an organic sulfur compound.

2 Claims, 1 Drawing Sheet

COPPER ELECTROLYTIC SOLUTION AND ELECTROLYTIC COPPER FOIL PRODUCED THEREWITH

TECHNICAL FIELD

This invention relates to a method for producing an electrolytic copper foil, and more particularly a copper electrolytic solution used in the production of an electrolytic copper foil that can be finely patterned and has excellent elongation and tensile strength both at ordinary and high temperatures.

BACKGROUND ART

An electrolytic copper foil is generally produced as follows. A rotating metal cathode drum with a polished surface is used along with an insoluble metal anode that surrounds said cathode drum and is disposed at a position substantially corresponding to the lower half of said cathode drum, a copper electrolytic solution is allowed to flow between the cathode drum and the anode, a potential differential is provided between these to electrodeposit copper onto the cathode drum, and the electrodeposited copper is peeled away from the cathode drum at the point of reaching a specific thickness, so that a copper foil is produced continuously.

A copper foil obtained in this way is generally called a raw foil, and after this it is subjected to a number of surface treatments and used for printed wiring boards and so forth.

FIG. 1 is a simplified diagram of a conventional apparatus for producing a copper foil. This electrolytic copper foil production apparatus has a cathode drum 1 installed in an electrolysis bath containing an electrolytic solution. This cathode drum 1 is designed to rotate while being partially submerged (substantially the lower half) in the electrolytic solution.

An insoluble anode 2 is provided so as to surround the outer peripheral lower half of this cathode drum 1. A specific gap 3 is maintained between the cathode drum 1 and the anode 2, and an electrolytic solution is allowed to flow through this gap. Two anode plates are disposed in the apparatus shown in FIG. 1.

With the apparatus in FIG. 1, the electrolytic solution is supplied from below, and this electrolytic solution goes through the gap 3 between the cathode drum 1 and the anode 2, overflows from the top edge of the anode 2, and is then recirculated. A rectifier is interposed between the cathode drum 1 and the anode 2 so that a specific voltage can be maintained between the two components.

As the cathode drum 1 rotates, the thickness of the copper electrodeposited from the electrolytic solution increases. When at least a certain thickness is reached, this raw foil 4 is peeled away and continuously taken up. A raw foil produced in this manner is adjusted for thickness by varying the distance between the cathode drum 1 and the anode 2, the flow rate of the supplied electrolytic solution, or the amount of electricity supplied.

A copper foil produced with an electrolytic copper foil producing apparatus such as this has a mirror surface on the side touching the cathode drum, but the opposite side is a rough surface with bumps and pits. Problems encountered with ordinary electrolysis are that the bumps and pits on the rough side are severe, undercutting tends to occur during etching, and fine patterning is difficult.

On the one hand, as the density on printed wiring boards has steadily risen, there has more recently been a need for a copper foil that can be more finely patterned as circuit width decreases and multilayer circuits are produced. This fine patterning requires a copper foil that has a good etching rate and uniform solubility, that is, a copper foil with excellent etching characteristics.

On the other hand, the performance needed in a copper foil used for printed wiring boards is not just its elongation at ordinary temperature, but also its high-temperature characteristics for preventing cracking caused by thermal stress, as well as high tensile strength for good dimensional stability in a printed wiring board. However, copper foil in which the bumps and pits of the rough surface side are severe as mentioned above has the problem of being totally unsuited to fine patterning, as discussed above. Because of this, smoothing the rough side to a low profile has been investigated.

It is known that achieving a low profile generally can be accomplished by adding a large amount of glue or thiourea to the electrolytic solution.

Nevertheless, a problem with such additives is that they sharply decrease the elongation at ordinary and high temperatures, which greatly lowers the performance of the copper foil when used for a printed wiring board.

It has also been proposed that the elongation characteristics of the resultant copper foil can be improved by using an adduct salt of a polyepichlorohydrin and a tertiary amine as an additive to a copper plating solution (Specification of U.S. Pat. No. 6,183,622).

However, the inventors have confirmed that this method actually results in deterioration of elongation characteristics, and does not contribute to achieving a lower profile.

DISCLOSURE OF THE INVENTION

It is an object of the present invention to provide a copper electrolytic solution used to obtain a low-profile electrolytic copper foil with low surface roughness on the rough side (the opposite side from the glossy side) in the production of an electrolytic copper foil using a cathode drum, and more particularly to provide a copper electrolytic solution used to obtain an electrolytic copper foil that has reduced transmission loss at a high frequency, can be finely patterned, and has excellent elongation and tensile strength both at ordinary and high temperatures.

The inventors learned that if optimal additives that afford a lower profile are added to an electrolytic solution, fine patterning will be possible and an electrolytic copper foil can be obtained with excellent elongation and tensile strength at both ordinary and high temperatures.

Based on this finding, the inventors examined additives that are added to an electrolytic solution in an electrolytic copper foil producing method in which a copper electrolytic solution is allowed to flow between a cathode drum and an anode, copper is electrodeposited on the cathode drum, and the electrodeposited copper foil is peeled away from the cathode drum to continuously produce a copper foil. As a result, they arrived at the present invention upon discovering that if electrolysis is performed using a copper electrolytic solution containing an organic sulfur compound and a quaternary amine compound with a specific structure, fine patterning will be possible and an electrolytic copper foil can be obtained with excellent elongation and tensile strength at both ordinary and high temperatures.

Specifically, the present invention is constituted as follows.

(1) A copper electrolytic solution containing as additives (A) at least one quaternary amine salt selected from the group consisting of (a) quaternary amine salts obtained by reaction between epichlorohydrin and an amine compound mixture composed of a secondary amine compound and a tertiary amine compound, and (b) polyepichlorohydrin quaternary amine salts, and (B) an organic sulfur compound.

(2) The copper electrolytic solution according to (1) above, wherein the polyepichlorohydrin quaternary amine salt is composed of repeating units expressed by the following General Formula (1):

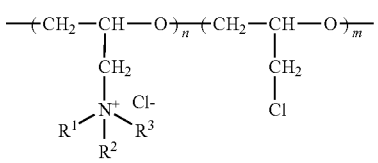

(1)

(in General Formula (1), $R^1$, $R^2$, and $R^3$ are each a methyl group or ethyl group, n is a number greater than zero, m is a number greater than zero, n+m=10 to 1000, and n/(n+m)≧0.65).

(3) The copper electrolytic solution according to (1) above, wherein the quaternary amine salt obtained by reaction between epichlorohydrin and an amine compound mixture composed of a secondary amine compound and a tertiary amine compound is expressed by the following General Formula (2):

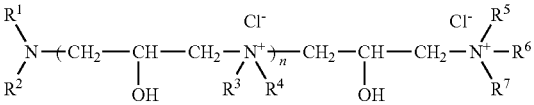

(2)

(in General Formula (2), $R^1$, $R^2$, $R^3$, $R^4$, $R^5$, $R^6$, and $R^7$ are each a methyl group or ethyl group, and n is a number from 1 to 1000).

(4) The copper electrolytic solution according to (1) above, wherein the organic sulfur compound is expressed by the following General Formula (3) or (4):

$$X—R^1—(S)_n—R^2—Y \quad (3)$$

$$R^4—S—R^3—SO_3Z \quad (4)$$

(in General Formulas (3) and (4), $R^1$, $R^2$, and $R^3$ are each an alkylene group with 1 to 8 carbon atoms, $R^4$ is selected from the group consisting of hydrogen,

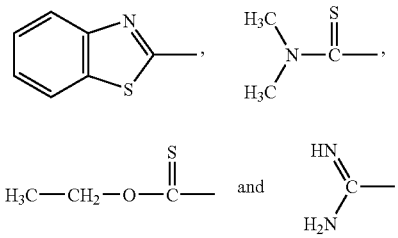

X is selected from the group consisting of hydrogen, a sulfonic acid group, a phosphonic acid group, and an alkali metal salt or ammonium base of sulfonic acid or phosphonic acid, Y is selected from the group consisting of a sulfonic acid group, a phosphonic acid group, and an alkali metal salt of sulfonic acid or phosphonic acid, Z is hydrogen or an alkali metal, and n is 2 or 3).

(5) An electrolytic copper foil produced using the copper electrolytic solution according to any of (1) to (4) above.

(6) A copper-clad laminated board produced using the electrolytic copper foil according to (5) above.

In the present invention, it is important that the copper electrolytic solution contain (A) at least one quaternary amine salt selected from the group consisting of (a) quaternary amine salts obtained by a reaction between epichlorohydrin and an amine compound mixture composed of a secondary amine compound and a tertiary amine compound, and (b) polyepichlorohydrin quaternary amine salts obtained by subjecting epichlorohydrin to ring-opening polymerization and then reacting this product with a tertiary amine compound, and (B) an organic sulfur compound. The object of the present invention will not be achieved by adding just one or the other of these.

The quaternary amine additive used in the present invention can be produced as follows.

The quaternary amine compound of General Formula (1) can be obtained by subjecting epichlorohydrin to ring-opening polymerization and then reacting the polyepichlorohydrin thus obtained with a tertiary amine compound. The ring-opening polymerization of the epichlorohydrin can be easily accomplished by using a known acid or base catalyst.

The reaction between the polyepichlorohydrin and the tertiary amine compound involves heating and stirring polyepichlorohydrin and a tertiary amine aqueous solution (1 to 10 times the molar amount of polyepichlorohydrin) at 100° C., for example, reacting the components for about 1 to 100 hours, and distilling off any unreacted tertiary amine.

In the above-mentioned General Formula (1), m+n=10 to 1000, but a range of 10 to 500 is preferred. Also, n/(n+m)≧0.65, but n/(n+m)≧0.8 is preferable.

The quaternary amine compound expressed by General Formula (2) is obtained by slowly adding a mixture of a secondary amine compound and a tertiary amine compound dropwise to epichlorohydrin at room temperature over a period of 30 minutes to 2 hours, and continuing a heating reaction at 40 to 80° C. for 1 to 5 hours after this dropwise addition. n in General Formula (2) is a number from 1 to 1000, but is preferably from 50 to 500.

The ratio between the secondary amine compound and tertiary amine compound in the amine mixture is preferably such that secondary amine compound:tertiary amine compound=5:95 to 95:5 (mol %). The ratio in which the epichlorohydrin and the amine mixture are reacted is preferably such that the epichlorohydrin:amine mixture (tertiary amine compound+secondary amine compound)=1:2 to 2:1 (mol %).

The organic sulfur compound is preferably a compound having a structure expressed by the above-mentioned General Formula (3) or (4).

In General Formulas (3) and (4), the alkali metal salt of sulfonic acid or phosphonic acid in X and Y is preferably a sodium salt or potassium salt, and the alkali metal in Z is preferably sodium or potassium.

The following are examples of the organic sulfur compound expressed by General Formula (3) that can be used favorably.

$$H_2O_3P—(CH_2)_3—S—S—(CH_2)_3—PO_3H_2$$

$$NaO_3S—(CH_2)_3—S—S—(CH_2)_3—SO_3Na$$

$$HO_3S—(CH_2)_2—S—S—(CH_2)_2—SO_3H$$

$CH_3—S—S—CH_2—SO_3H$ $NaO_3S—(CH_2)_3—S—S—S—(CH_2)_3—SO_3Na$ $(CH_3)_2CH—S—S—(CH_2)_2—SO_3H$

The following are examples of the organic sulfur compound expressed by the above-mentioned General Formula (4) that can be used favorably.

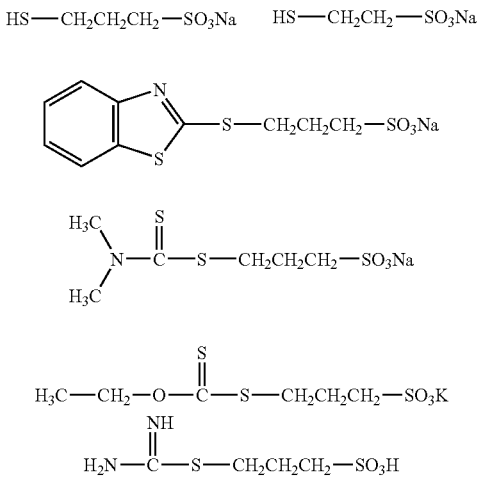

The ratio (weight ratio) of the quaternary amine compound and the organic sulfur compound in the copper electrolytic solution is preferably from 1:5 to 5:1, and even more preferably from 1:2 to 2:1. The concentration of the quaternary amine compound in the copper electrolytic solution is from 0.1 to 500 ppm, and preferably from 1 to 50 ppm.

It is important that the copper electrolytic solution of the present invention contain the above-mentioned specific quaternary amine compound and organic sulfur compound, but can also contain other components used in the past. For example, in addition to the above-mentioned amine compound and organic sulfur compound, polyethylene glycol, polypropylene glycol, and other such polyether compounds, polyethyleneimine, phenazine dyes, glue, cellulose, and other such known additives may be added to the copper electrolytic solution.

Also, the copper-clad laminated board obtained by laminating the electrolytic copper foil of the present invention has excellent smoothness and excellent elongation and tensile strength at both ordinary and high temperatures, and is therefore a copper-clad laminated board that is suited to fine patterning.

BEST MODE FOR CARRYING OUT THE INVENTION

Figure 1:
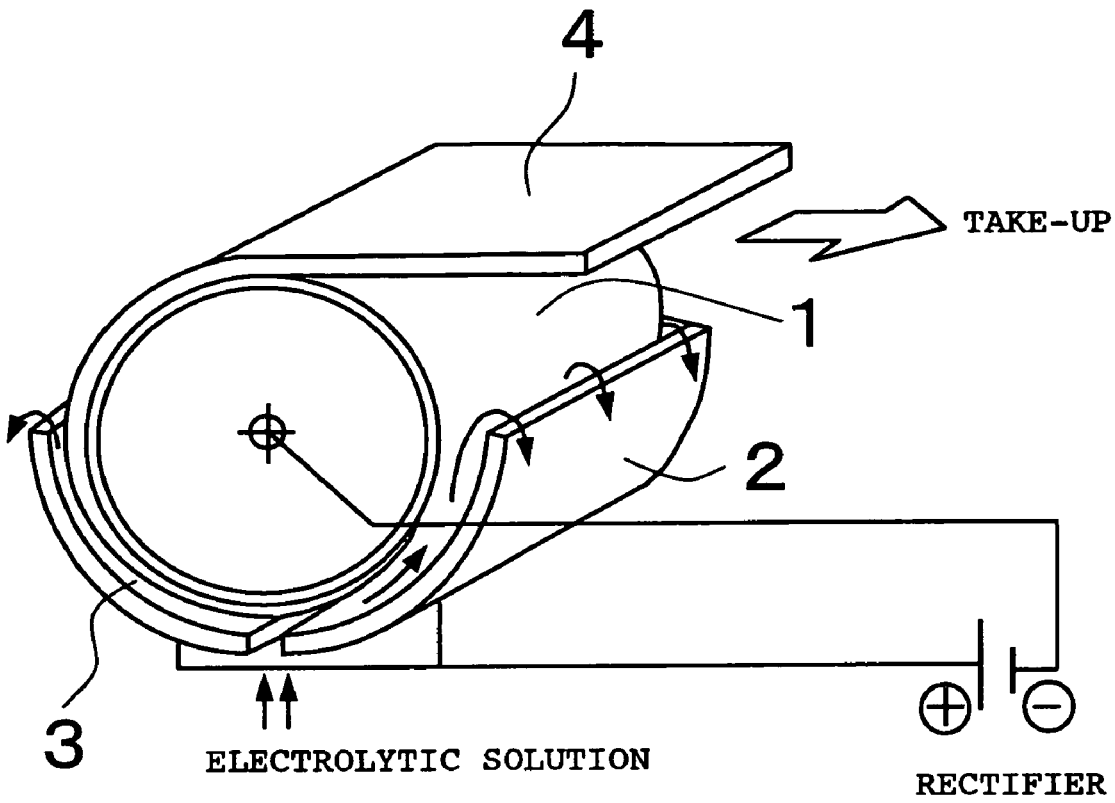
FIG. 1 is a simplified diagram of an apparatus for producing a copper foil.

The present invention will now be described in further detail through examples.

EXAMPLES 1 TO 12 AND COMPARATIVE EXAMPLES 1 TO 9

The electrolytic copper foil producing apparatus shown in FIG. 1 was used to produce electrolytic copper foils with a thickness of 35 μm. The composition of the electrolytic solution was as follows.

Cu: 90 g/L $H_2SO_4$: 80 g/L

Cl: 60 ppm

Solution temperature: 55 to 57° C.

Additive B1: bis(3-sulfopropyl)disulfide disodium (SPS, made by Raschig Corporation)

Additive B2: sodium salt of 3-mercapto-1-propanesulfonic acid (MPS, made by Raschig Corporation)

Additive A: a quaternary amine compound having a specific structure a1 to a5: reaction product of epichlorohydrin and mixture of trimethylamine and dimethylamine

TABLE 1

Reaction product of epichlorohydrin and mixture of trimethylamine and dimethylamine

| | Epichlorohydrin (mol %) | Trimethylamine (mol %) | Dimethylamine (mol %) | Reaction temperature (° C.) | Reaction time (hours) |
|---|---|---|---|---|---|
| a1 | 100 | 80 | 20 | 60 | 3 |
| a2 | 100 | 60 | 40 | 60 | 3 |
| a3 | 100 | 80 | 20 | 80 | 3 |
| a4 | 100 | 60 | 40 | 80 | 3 |
| a5 | 100 | 95 | 5 | 100 | 3 |

b: trimethylamine salt of polyepichlorohydrin expressed by the following formula (m:n=1:6, molecular weight: 4000)

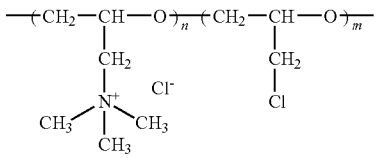

The surface roughness Rz (μm), ordinary temperature elongation (%), ordinary temperature tensile strength (kfg/mm$^2$), high temperature elongation (%), and high temperature tensile strength (kfg/mm$^2$) of the electrolytic copper foils thus obtained were measured. These results are given in Tables 2-1 and 2-2.

These measurements were conducted according to the following methods.

Surface roughness Rz: JIS B 0601

Ordinary temperature elongation, ordinary temperature tensile strength, high temperature elongation, and high temperature tensile strength: IPC-TM650

TABLE 2-1

| | Additive B1 (ppm) | Additive B2 (ppm) | Additive A (ppm) b | a1 | a2 | a3 | a4 | a5 | Rz (μm) | Ordinary temperature elongation (%) | Ordinary temperature tensile strength (kgf/mm$^2$) | High temperature elongation (%) | High temperature tensile strength (kgf/mm$^2$) |
|---|---|---|---|---|---|---|---|---|---|---|---|---|---|
| Example 1 | 50 | 0 | 50 | 0 | 0 | 0 | 0 | 0 | 0.93 | 6.85 | 31.0 | 16.5 | 20.6 |
| Example 2 | 50 | 0 | 0 | 50 | 0 | 0 | 0 | 0 | 1.17 | 10.34 | 34.7 | 18.5 | 20.1 |
| Example 3 | 50 | 0 | 0 | 0 | 50 | 0 | 0 | 0 | 1.02 | 5.32 | 76.5 | 13.3 | 20.1 |
| Example 4 | 50 | 0 | 0 | 0 | 0 | 50 | 0 | 0 | 1.45 | 3.00 | 48.7 | 17.6 | 20.3 |
| Example 5 | 50 | 0 | 0 | 0 | 0 | 0 | 50 | 0 | 1.23 | 8.42 | 35.4 | 11.8 | 20.0 |
| Example 6 | 50 | 0 | 0 | 0 | 0 | 0 | 0 | 50 | 1.78 | 8.59 | 33.6 | 8.8 | 20.3 |
| Example 7 | 0 | 50 | 50 | 0 | 0 | 0 | 0 | 0 | 1.10 | 6.55 | 33.0 | 15.3 | 21.0 |
| Example 8 | 0 | 50 | 0 | 50 | 0 | 0 | 0 | 0 | 1.23 | 9.55 | 33.1 | 17.9 | 21.0 |
| Example 9 | 0 | 50 | 0 | 0 | 50 | 0 | 0 | 0 | 1.11 | 5.35 | 45.6 | 15.6 | 21.4 |
| Example 10 | 0 | 50 | 0 | 0 | 0 | 50 | 0 | 0 | 1.51 | 3.10 | 45.0 | 17.6 | 23.0 |
| Example 11 | 0 | 50 | 0 | 0 | 0 | 0 | 50 | 0 | 1.25 | 8.59 | 36.1 | 12.0 | 21.5 |
| Example 12 | 0 | 50 | 0 | 0 | 0 | 0 | 0 | 50 | 1.55 | 6.80 | 33.2 | 8.9 | 21.5 |

TABLE 2-2

| | Additive B1 (ppm) | Additive B2 (ppm) | Additive A (ppm) b | a1 | a2 | a3 | a4 | a5 | Rz (μm) | Ordinary temperature elongation (%) | Ordinary temperature tensile strength (kgf/mm$^2$) | High temperature elongation (%) | High temperature tensile strength (kgf/mm$^2$) |
|---|---|---|---|---|---|---|---|---|---|---|---|---|---|
| Comp. Ex. 1 | 0 | 0 | 0 | 0 | 0 | 0 | 0 | 0 | 5.8 | 8.90 | 37.9 | 12.6 | 20.7 |
| Comp. Ex. 2 | 100 | 0 | 0 | 0 | 0 | 0 | 0 | 0 | 5.3 | 0.2 | 10.3 | 1.0 | 15.3 |
| Comp. Ex. 3 | 0 | 100 | 0 | 0 | 0 | 0 | 0 | 0 | 6.1 | 0.2 | 11.2 | 1.2 | 14.9 |
| Comp. Ex. 4 | 0 | 0 | 100 | 0 | 0 | 0 | 0 | 0 | 5.5 | 0.4 | 11.1 | 1.3 | 15.7 |
| Comp. Ex. 5 | 0 | 0 | 0 | 100 | 0 | 0 | 0 | 0 | 5.7 | 0.2 | 10.3 | 1.1 | 15.4 |
| Comp. Ex. 6 | 0 | 0 | 0 | 0 | 100 | 0 | 0 | 0 | 5.2 | 0.1 | 12.1 | 1.0 | 14.9 |
| Comp. Ex. 7 | 0 | 0 | 0 | 0 | 0 | 100 | 0 | 0 | 6.2 | 0.1 | 11.4 | 1.2 | 15.2 |
| Comp. Ex. 8 | 0 | 0 | 0 | 0 | 0 | 0 | 100 | 0 | 5.8 | 0.2 | 12.3 | 1.3 | 14.3 |
| Comp. Ex. 9 | 0 | 0 | 0 | 0 | 0 | 0 | 0 | 100 | 6.3 | 0.1 | 10.7 | 1.2 | 12.9 |

As shown in Table 2 above, in Examples 1 to 12, in which the additives of the present invention (the organic sulfur compound and quaternary amine compound having a specific structure) were added, the surface roughness Rz was between 0.93 and 1.78 μm, the ordinary temperature elongation was from 3.10 to 10.34 (%), the ordinary temperature tensile strength was from 31.0 to 76.5 (kgf/mm$^2$), the high temperature elongation was from 8.8 to 18.5 (%), and the high temperature tensile strength was from 20.0 to 23.0 (kgf/mm$^2$). Thus, despite the fact that a much lower profile was achieved, the ordinary temperature elongation, ordinary temperature tensile strength, high temperature elongation, and high temperature tensile strength were all as good or better than those in Comparative Example 1, in which neither additive was added.

COMPARATIVE EXAMPLES 10 AND 11

Other than not using the combination of additives of the present invention for the electrolytic solution, and using thiourea as shown in Table 3 instead of the organic sulfur compound, an electrolytic copper foil was produced and evaluated in the same manner as in Example 1. These results are given in Table 3.

TABLE 3

| | Thiourea (ppm) | b (ppm) | Rz (μm) | Ordinary temp. elongation (%) | Ordinary temp. tensile strength (kgf/mm$^2$) | High temp. elongation (%) | High temp. tensile strength (kgf/mm$^2$) |
|---|---|---|---|---|---|---|---|
| Comp. Ex. 10 | 50 | 50 | Foil formation was impossible (impossible to peel from drum) | | | | |
| Comp. Ex. 11 | 5 | 95 | 2.37 | 1.23 | 50.9 | 1.62 | 16.1 |

b: trimethylamine salt of polyepichlorohydrin

As shown in Table 3, the electrolytic solutions of Comparative Examples 10 and 11 were effective in terms of lowering the profile, but this effect was still inferior to that of the present invention.

In contrast to these, a lower profile could not be achieved with Comparative Example 1, in which no additive was used, or in Comparative Examples 2 to 9, in which just one additive was used. Also, the results for ordinary temperature elongation, ordinary temperature tensile strength, high temperature elongation, and high temperature tensile strength were actually worse when just one additive was used. The above confirms that the addition of the quaternary amine compound and organic sulfur compound specified in the present invention is extremely effective at lowering the profile on the rough side of an electrolytic copper foil, that not only elongation at ordinary temperature, but also the high temperature elongation characteristics can be effectively maintained, and that a high tensile strength is similarly obtained. The above-mentioned joint addition is important, and it can be seen that the above characteristics can be obtained only when both additives are used.

INDUSTRIAL APPLICABILITY

As described above, using the copper electrolytic solution of the present invention affords a marked reduction in profile height, and allows an electrolytic copper foil to be obtained with excellent ordinary temperature elongation, ordinary temperature tensile strength, high temperature elongation, and high temperature tensile strength. Furthermore, using this electrolytic copper foil allows the resulting copper-clad laminated board to be finely patterned.

The invention claimed is:

1. A copper electrolytic solution for producing an electrolytic copper foil, said solution comprising:

(A) a quaternary amine salt obtained by a reaction between epichlorohydrin and an amine compound mixture composed of a secondary amine compound and a tertiary amine compound; and (B) an organic sulfur compound, wherein the quaternary amine salt is expressed by the following General Formula (2):

(2)

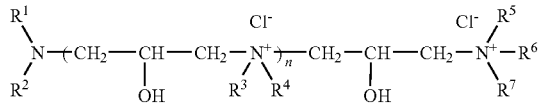

and, in General Formula (2), $R^1$, $R^2$, $R^3$, $R^4$, $R^5$, $R^6$ and $R^7$ are each a methyl group or an ethyl group and n is a number from 1 to 1000.

2. The copper electrolytic solution according to claim 1, wherein the organic sulfur compound is expressed by the following General Formula (3) or (4):

$$X—R^1—(S)_n—R^2—Y \quad (3)$$

$$R^4—S—R^3—SO_3Z \quad (4)$$

in General Formulas (3) and (4), $R^1$, $R^2$, and $R^3$ are each an alkylene group with 1 to 8 carbon atoms, $R^4$ is selected from the group consisting of hydrogen,

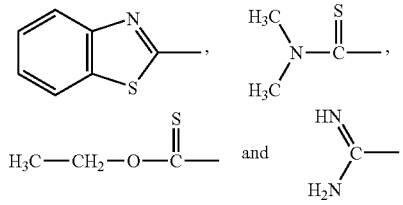

X is selected from the group consisting of hydrogen, a sulfonic acid group, a phosphonic acid group, and an alkali metal salt or ammonium base of sulfonic acid or phosphonic acid, Y is selected from the group consisting of a sulfonic acid group, a phosphonic acid group, and an alkali metal salt of sulfonic acid or phosphonic acid, Z is hydrogen or an alkali metal, and n is 2 or 3.

* * * * *